US012729084B2

(12) United States Patent
Ishida et al.

(10) Patent No.: US 12,729,084 B2
(45) Date of Patent: Sep. 8, 2026

(54) SHEET FEEDING APPARATUS

(71) Applicant: CANON KABUSHIKI KAISHA, Tokyo (JP)

(72) Inventors: Toshiki Ishida, Chiba (JP); Wataru Murata, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 230 days.

(21) Appl. No.: 18/762,904

(22) Filed: Jul. 3, 2024

(65) Prior Publication Data

US 2025/0019190 A1 Jan. 16, 2025

(30) Foreign Application Priority Data

Jul. 13, 2023 (JP) ..... 2023-115501

(51) Int. Cl.
*B65H 3/48* (2006.01)

(52) U.S. Cl.
CPC ..... *B65H 3/48* (2013.01); *B65H 2301/4234* (2013.01)

(58) Field of Classification Search
CPC ... B65H 3/46; B65H 3/48; B65H 5/22; B65H 5/228; B65H 2301/4234
USPC ..... 271/97
See application file for complete search history.

(56) References Cited

U.S. PATENT DOCUMENTS

2023/0219776 A1* 7/2023 Iwami ..... B65H 3/128 271/18
2024/0286857 A1* 8/2024 Kawakita ..... B65H 29/00
2024/0294347 A1* 9/2024 Kai ..... B65H 3/48
2025/0004407 A1* 1/2025 Deno ..... G03G 15/6505
2025/0110438 A1* 4/2025 Nagatomo ..... G03G 15/5008
2025/0251689 A1* 8/2025 Kawakita ..... G03G 15/6511

FOREIGN PATENT DOCUMENTS

JP 2006256819 A 9/2006
JP 2016224193 A * 12/2016
JP 2023161579 A * 11/2023 ..... B65H 3/0684

* cited by examiner

*Primary Examiner* — Leslie A Nicholson, III
(74) *Attorney, Agent, or Firm* — ROSSI, KIMMS & McDOWELL LLP

(57) ABSTRACT

A sheet feeding apparatus includes a sheet supporting portion, a sheet feeding unit configured to perform a feeding operation, an air separation unit configured to perform a blowing operation, and a control unit configured to execute a sheet feeding control. In the sheet feeding control, in a case where a second number of sheets, separated by the blowing operation but not fed, remains on the sheet supporting portion at an end of a first job, and a number of printing sheets of a second job subsequent to the first job is a third number of sheets that is equal to or less than the second number of sheets, the control unit omits an initial blowing operation and starts the feed operation in the second job.

17 Claims, 10 Drawing Sheets

SHEET FEEDING APPARATUS

BACKGROUND OF THE INVENTION

Field of the Invention

This disclosure relates to a sheet feeding apparatus that feeds a sheet.

Description of the Related Art

In recent years, there has been an increased demand for printing images on various types of sheets, and, for example, sheets with a smooth surface property such as coated paper are sometimes used as recording materials. In a case where sheet bundles with such a smooth surface property are set to sheet feeding apparatuses that feed the sheet, high adhesion force between the sheets can cause difficulty in feeding. According to Japanese Patent Laid-Open No. 2006-256819, a sheet feeding apparatus which separates the sheet by blowing air onto the sheet bundle to release adhesion between the sheets is proposed.

Using FIG. 10, standard control performed in the feeding of the sheet while blowing the air onto the sheet bundle to separate the sheet, as described in Japanese Patent Laid-Open No, 2006-256819, will be described. As illustrated in FIG. 10, for example, when the control to perform the feeding of the sheet is started upon receiving a command such as to start a print job (STEP S101), first, air blowing toward the sheet bundle is initiated (STEP S102). Thereby, a few to several dozen sheets at the top of the sheet bundle are separated. Further, the air blowing is continued until a predetermined time (for example, 10 seconds) has passed from the initiation of the air blowing (STEPS103: No). Subsequently, when the predetermined time has passed from the initiation of the air blowing (STEP S103: Yes), a feeding operation to feed the sheet with respect to an image forming unit using such as a pickup roller is performed (STEP S104). Then, the feeding operation is repeated until the number of sheets fed to the image forming unit has reached a required number of sheets based on instructions of the print job (STEP S105: No), and, upon reaching the required number of sheets (STEP S105: Yes), by stopping the air blowing (STEP S106), this control is ended (STEP S107).

However, in the control described above, when a second job subsequent to a first job is started after the completion of the first job, sometimes, the sheet onto which the air has already been blown in the first job to release the adhesion between the sheets is loaded. In such a case, according to the control described above, in the second job, the air blowing operation is performed also with respect to the sheet whose adhesion has already been released. Therefore, there is a possibility that productivity may decrease.

SUMMARY OF THE INVENTION

According to a first aspect of the present invention, a sheet feeding apparatus includes a sheet supporting portion configured to support a sheet bundle, a sheet feeding unit configured to perform a feeding operation of coming into contact with and feeding an uppermost sheet of the sheet bundle supported on the sheet supporting portion, an air separation unit configured to perform a blowing operation of separating a sheet by blowing air to a side surface of the sheet bundle supported on the sheet supporting portion, and a control unit configured to execute a sheet feeding control of executing the blowing operation by the air separation unit, of stopping the blowing operation, and of executing the feeding operation in a state in which the blowing operation is stopped, the control unit, in the sheet feeding control, being configured to execute the blowing operation each time when a first number of sheets has been fed until feeding the sheet for a number of printing sheets as specified by a job has been completed. In the sheet feeding control, in a case where a second number of sheets, separated by the blowing operation but not fed, remains on the sheet supporting portion at an end of a first job, and a number of printing sheets of a second job subsequent to the first job is a third number of sheets that is equal to or less than the second number of sheets, the control unit omits an initial blowing operation and starts the feed operation in the second job.

According to a second aspect of the present invention, a sheet feeding apparatus includes a sheet supporting portion configured to support a sheet bundle, a sheet feeding unit configured to perform a feeding operation of coming into contact with and feeding an uppermost sheet of the sheet bundle supported on the sheet supporting portion, an air separation unit configured to perform a blowing operation of separating a sheet by blowing air to a side surface of the sheet bundle supported on the sheet supporting portion, and a control unit configured to execute a sheet feeding control of executing the blowing operation by the air separation unit, of stopping the blowing operation, and of executing the feeding operation in a state in which the blowing operation is stopped, the control unit, in the sheet feeding control, being configured to execute the blowing operation each time when a first number of sheets has been fed until feeding the sheet for a number of printing sheets as specified by a job has been completed. In the sheet feeding control, in a case where a fourth number of sheets fed after the blowing operation is less than the first number of sheets at an end of a first job, the control unit omits an initial blowing operation and starts the feed operation in a second job subsequent to the first job.

Further features of the present invention will become apparent from the following description of exemplary embodiments with reference to the attached drawings.

DESCRIPTION OF THE EMBODIMENTS

First Embodiment

Figure 1:
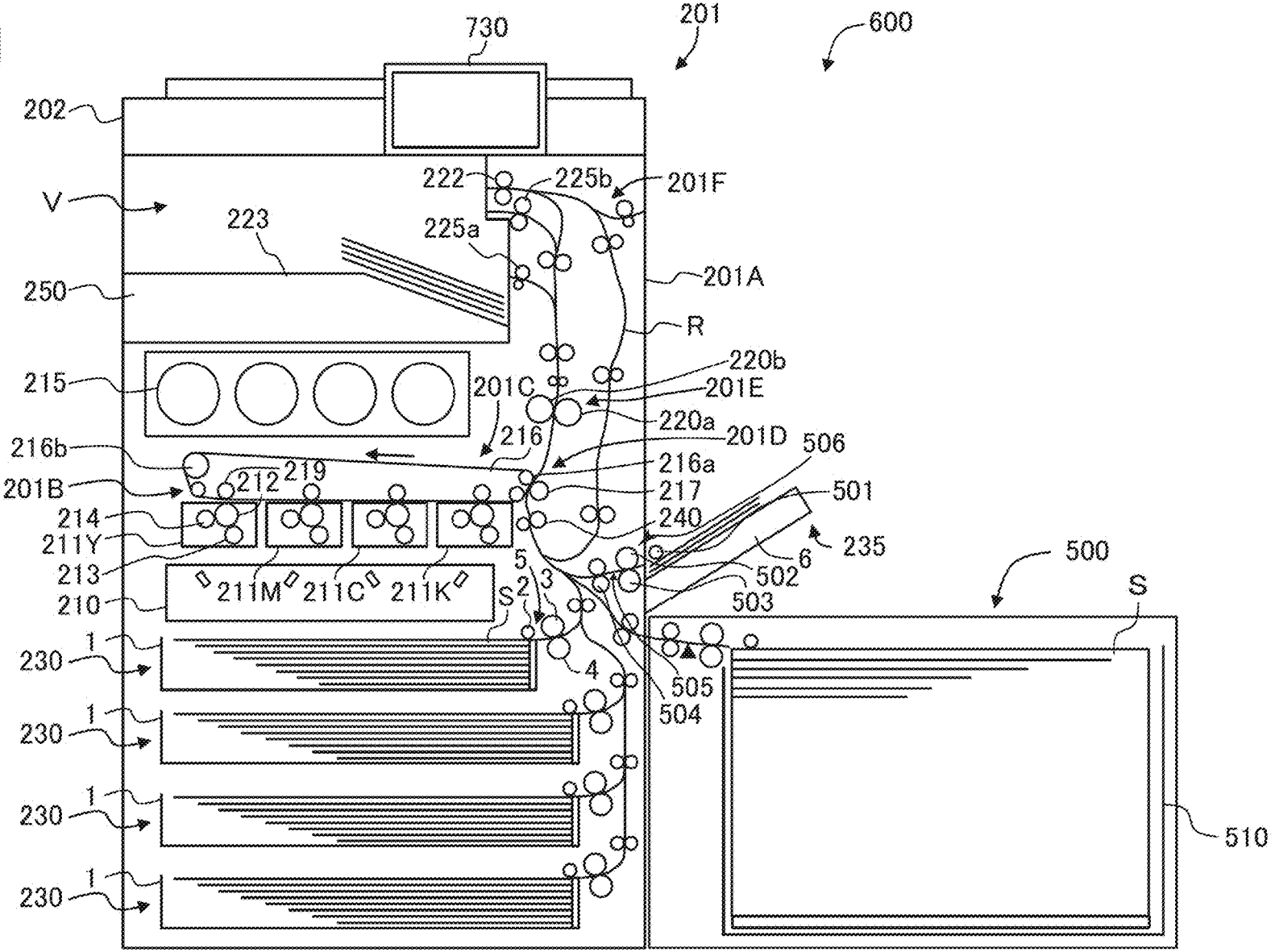
FIG. 1 is an overall schematic diagram illustrating an image forming system of the present embodiment.

Hereinafter, with reference to drawings, a first embodiment of this disclosure will be described in detail. First, using FIG. 1, an image forming system 600 including a feed deck 500 and an image forming apparatus 201 connected to the feed deck 500 will be described. FIG. 1 is a diagram illustrating a schematic configuration of the image forming system of the first embodiment.

Schematic Configuration of Image Forming System

As illustrated in FIG. 1, the image forming system 600 includes the image forming apparatus 201 and the feed deck 500 connected to the image forming apparatus 201. The feed deck 500 is connected to a right side of the image forming apparatus 201 in FIG. 1, and is configured to feed a sheet S to the image forming apparatus 201.

Schematic Configuration of Image Forming Apparatus

As illustrated in FIG. 1, the image forming apparatus 201 includes an image forming apparatus body 201A incorporating an image forming unit 201B that forms an image on the sheet, and an image reading apparatus 202 arranged on the top of the image forming apparatus body 201A. A discharge space V for discharging the sheet is formed between this image reading apparatus 202 and the image forming apparatus body 201A. To be noted, an operation unit 730 configured with such as a touch panel capable of displaying a screen is arranged on the top of the image forming apparatus body 201A.

The image forming unit 201B adopts a four-drum full-color method. The image forming unit 201B includes a laser scanner 210 and four process cartridges 211Y, 211M, 211C, and 211K respectively forming toner images of four colors: yellow (Y), Magenta (M), cyan (C), and black (K). Here, each of the process cartridges 211 includes a photosensitive drum 212, a charge unit 213, and a developing unit 214. Further, the image forming unit 201B includes an intermediate transfer unit 201C arranged on the top of the process cartridges 211, and a fixing unit 201E. To be noted, toner cartridges 215 for supplying toners to the developing units 214 are arranged above the image forming unit 201B. The intermediate transfer unit 210C includes an intermediate transfer belt 216 that is wound around a drive roller 216*a* and a tension roller 216*b*. To be noted, primary transfer rollers 219 which each come into contact with the intermediate transfer belt 216 at positions directly facing the photosensitive drums 212 are arranged inside of the intermediate transfer belt 216. Here, the intermediate transfer belt 216 is rotated in an arrow direction in FIG. 1 by the drive roller 216*a*, driven by a driving unit, not shown.

Then, the toner images of each color bearing a negative polarity on the photosensitive drums are sequentially transferred and superimposed onto the intermediate transfer belt 216 by the primary transfer rollers 219. A secondary transfer roller 217 that transfers a color image formed on the intermediate transfer belt 216 onto the sheet S is disposed at a position facing the drive roller 216*a* of the intermediate transfer unit 201C. A secondary transfer portion 201D is formed by these intermediate transfer belt 216 and the secondary transfer roller 217. Further, the fixing unit 201E that includes a press roller 220*a* and a heating roller 220*b* is arranged above this secondary transfer roller 217. Further, a first sheet discharge roller pair 225*a*, a second sheet discharge roller pair 225*b*, and a duplex reverse portion 201F are arranged on an upper left side of this fixing unit 201E. In this duplex reverse portion 201F, a reverse roller pair 222 that can rotate in forward and reverse directions, and a re-conveyance path R that conveys the sheet with the image formed on a first surface back to the image forming unit 201B are disposed.

A plurality (in this embodiment, four) of sheet feed units 230 that send the sheet S, which has been set, to the image forming unit 201B are disposed in a lower part of the image forming apparatus body 201A. Each of the sheet feed units 230 includes a feed cassette 1 and a sheet feeding unit 5 that feeds the sheet S stored in the feed cassette 1. The sheet feeding unit 5 includes a pickup roller 2, a feed roller 3, and a retard roller 4. The feed roller 3 and the retard roller 4 serve as a separation unit that separates the sheet S sent by the pickup roller 2 in cases of double-feed.

Further, a manual sheet feed portion 235 that sends the sheet S, which has been set, to image forming unit 201B is disposed on a right side surface of the image forming apparatus body 201A in FIG. 1. The manual sheet feed portion 235 includes a manual feed tray 6, serving as a sheet supporting portion. The manual feed tray 6 is supported in an openable and closable manner with respect to the image forming apparatus body 201A, serving as a casing. A detailed configuration of the manual sheet feed portion 235 will be described below. Further, the feed deck 500 that sends the sheet S, which has been set, to the image forming unit 201B is disposed to the right side surface of the image forming apparatus body 201A in FIG. 1, and below the manual sheet feed portion 235.

Next, an image formation operation of the image forming apparatus 201 will be described. First, when the image reading apparatus 202 has read the image information of a document, this image information undergoes image processing and then is converted into an electrical signal, which are transmitted to the laser scanner 210 of the image forming unit 201B. In the image forming unit 201B, surfaces of the photosensitive drums whose surfaces are charged to a predetermined polarity and electric potential by the charge units 213 are sequentially irradiated with a laser beam. Thereby, electrostatic latent images of yellow, magenta, cyan, and black are sequentially formed on the photosensitive drums of each process cartridge 211.

Thereafter, these electrostatic latent images are visualized by being developed with the toners of each color, and, by applying a primary transfer bias to the primary transfer rollers 219, the toner images of each color on each photosensitive drum are sequentially superimposed and transferred onto the intermediate transfer belt 216. Thereby, the toner image is formed on the intermediate transfer belt 216.

On the other hand, the sheet S fed by the feed roller 3 of the sheet feed unit 230 is conveyed to a registration roller pair 240 constituted from a drive roller and driven roller. At this time, the drive of the registration roller pair 240 is stopped, and a leading edge of the sheet S is abutted against the registration roller pair 240. Thereby, the leading edge of the sheet S is aligned with the registration roller pair 240. Thereafter, since the feed roller 3 continues the conveyance of the sheet S, a bend (loop) is formed in the sheet S, and, when a loop amount becomes a predetermined amount, the registration roller pair 240 is driven. Thereby, the skew of the sheet S is corrected by the registration roller pair 240, and the sheet S with the skew corrected is conveyed to the secondary transfer portion 201D by the registration roller pair 240. Subsequently, in the secondary transfer portion 201D, the toner image is collectively transferred onto the sheet S by applying a secondary transfer bias to the secondary transfer roller 217. Then, the sheet S onto which the toner image has been transferred is conveyed to the fixing unit 201E, and, by receiving heat and pressure in the fixing unit 201E, the toners of each color are melted and mixed, and are fixed on the sheet S as a color image.

Thereafter, the sheet S on which the image has been fixed is discharged to the discharge space V by the first or second sheet discharge roller pair 225*a* or 225*b* disposed downstream of the fixing unit 201E in a sheet discharge direction, and is supported on a supporting portion 223 formed on a bottom surface of the discharge space V. To be noted, when the image is formed on both surfaces of the sheet S, after the image have been fixed on a first surface of the sheet S, the sheet S is conveyed to the re-conveyance path R by the reverse roller pair 222, and, again, is conveyed to the image forming unit 201B. Then, the image is formed on a second surface opposite to the first surface of the sheet S, and the sheet S is discharged to the supporting portion 223.

Configuration of Manual Sheet Feed Portion

Figure 3:
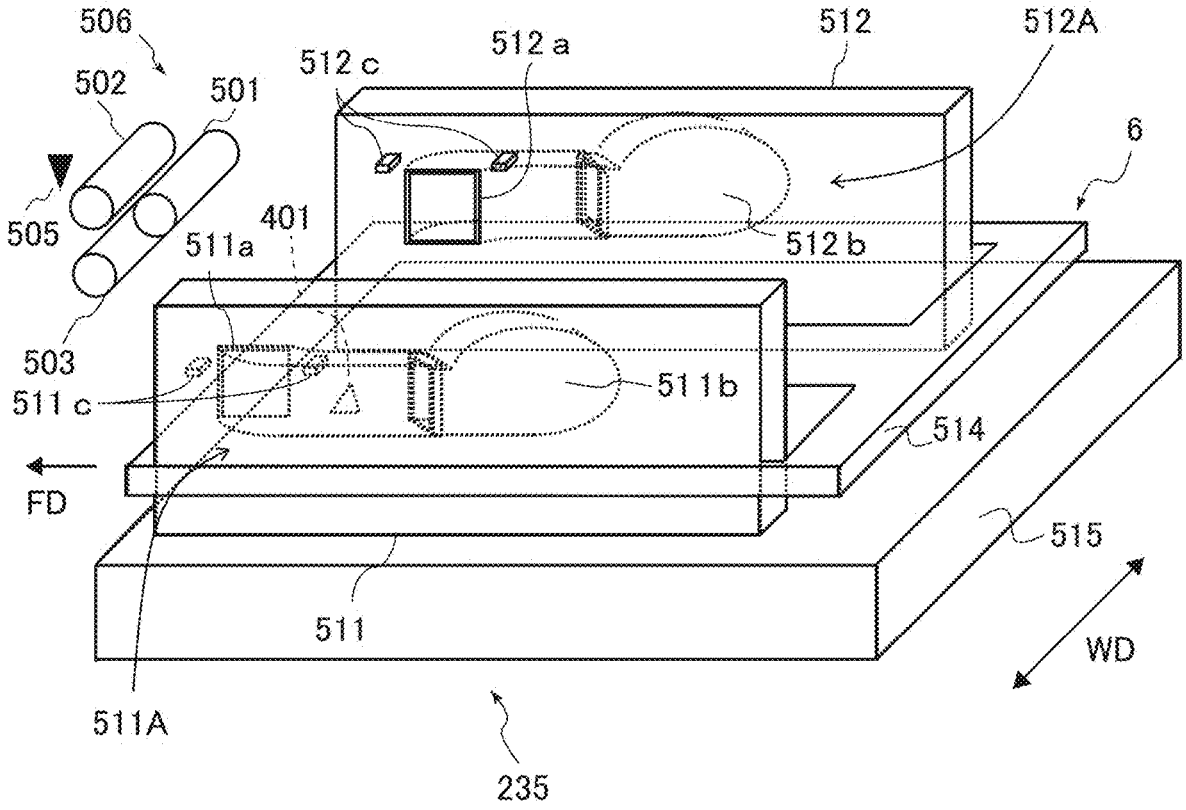
FIG. 3 is a schematic diagram illustrating a configuration of a manual sheet feed portion.

Next, using FIGS. 1 and 3, details of the manual sheet feed portion 235, serving as a sheet feeding apparatus, will be described. FIG. 3 is a schematic diagram illustrating a configuration of the manual sheet feed portion 235 of the present embodiment. As illustrated in FIGS. 1 and 3, the manual sheet feed portion 235 includes the manual feed tray 6 and a sheet feeding unit 506 that feeds the sheet and separates a double-fed sheet.

Further, the sheet feeding unit 506 includes a pickup roller 501, serving as a feed roller that comes into contact with an uppermost sheet of a sheet bundle supported on a sheet supporting plate 514, described below, and feeds the uppermost sheet. Further, the sheet feeding unit 506 includes a feed roller 502 and a retard roller 503. The feed roller 502 and the retard roller 503 serve as a separation unit that separates the sheet S fed from the pickup roller 501.

Further, in the manual sheet feed portion 235, a drawing roller 504 (refer to FIG. 1) that feeds the sheet S to the image forming apparatus 201 by drawing the sheet S from the feed roller 502 is arranged downstream of the feed roller 502 in a sheet feeding direction. A feed sensor 505 is arranged between the feed roller 502 and the drawing roller 504 in the sheet feeding direction, that is, further downstream than the sheet feeding unit 506 in the sheet feeding direction. This feed sensor 505 detects the passage of the sheet S by outputting a signal depending on the presence and absence of the sheet S.

Further, as illustrated in FIG. 3, the manual feed tray 6 includes the sheet supporting plate 514 that loads and supports the sheet bundle comprised of a plurality of sheets of the sheet S, a supporting base 515 supporting the sheet supporting plate 514, and a sheet presence and absence sensor 401. The sheet presence and absence sensor 401 can detect the presence and absence of the sheet (including the sheet bundle) on the sheet supporting plate 514. For example, the sheet presence and absence sensor 401 may be a flag sensor that detects a position of a flag which moves when pressed by the sheet supported on the sheet supporting plate 514, or may be a photosensor that detects reflected light reflected by the sheet.

Further, the manual feed tray 6 includes side edge regulation plates 511 and 512 and a trailing edge regulating plate 513. The side edge regulation plates 511 and 512, serving as regulation portions, regulate positions of edges of the sheet S (side edges of the sheet) set on the sheet supporting plate 514 in a width direction. The width direction W of the sheet S is a direction orthogonal to the sheet feeding direction FD of the sheet S (sheet bundle). Further, the trailing edge regulating plate 513 regulates an upstream edge (trailing edge of the sheet) of the sheet S in the sheet feeding direction.

Air blowing units 511A and 512A, serving as air separation units, are respectively disposed in these side edge regulation plates 511 and 512. The air blowing unit 511A of the side edge regulation plate 511 includes a fan 511*b* driven by a fan motor 511M (refer to FIG. 2) and an air blow nozzle 511*a* that guides air blown from the fan 511*b* to blow onto a side of the sheet bundle. Similarly, the air separation portion 512A of the side edge regulation plate 512 includes a fan 512*b* driven by a fan motor 512M (refer to FIG. 2) and an air blow nozzle 512*a* that guides the air blown from the fan 512*b* to blow onto the side of the sheet bundle. These air blow nozzles 511*a* and 512*a*, serving as air blowing ports, possess a duct function for guiding the air within interiors of the side edge regulation plates 511 and 512. In the side regulation plates 511 and 512, hold-up plates 511*c* and 512*c* are disposed near the air blow nozzles 511*a* and 512*a* so as to prevent the sheet S, to which the air has been blown, from being ascended to cross over the side edge regulation plates 511 and 512.

Configuration of Control System of Image Forming System

Figure 2:
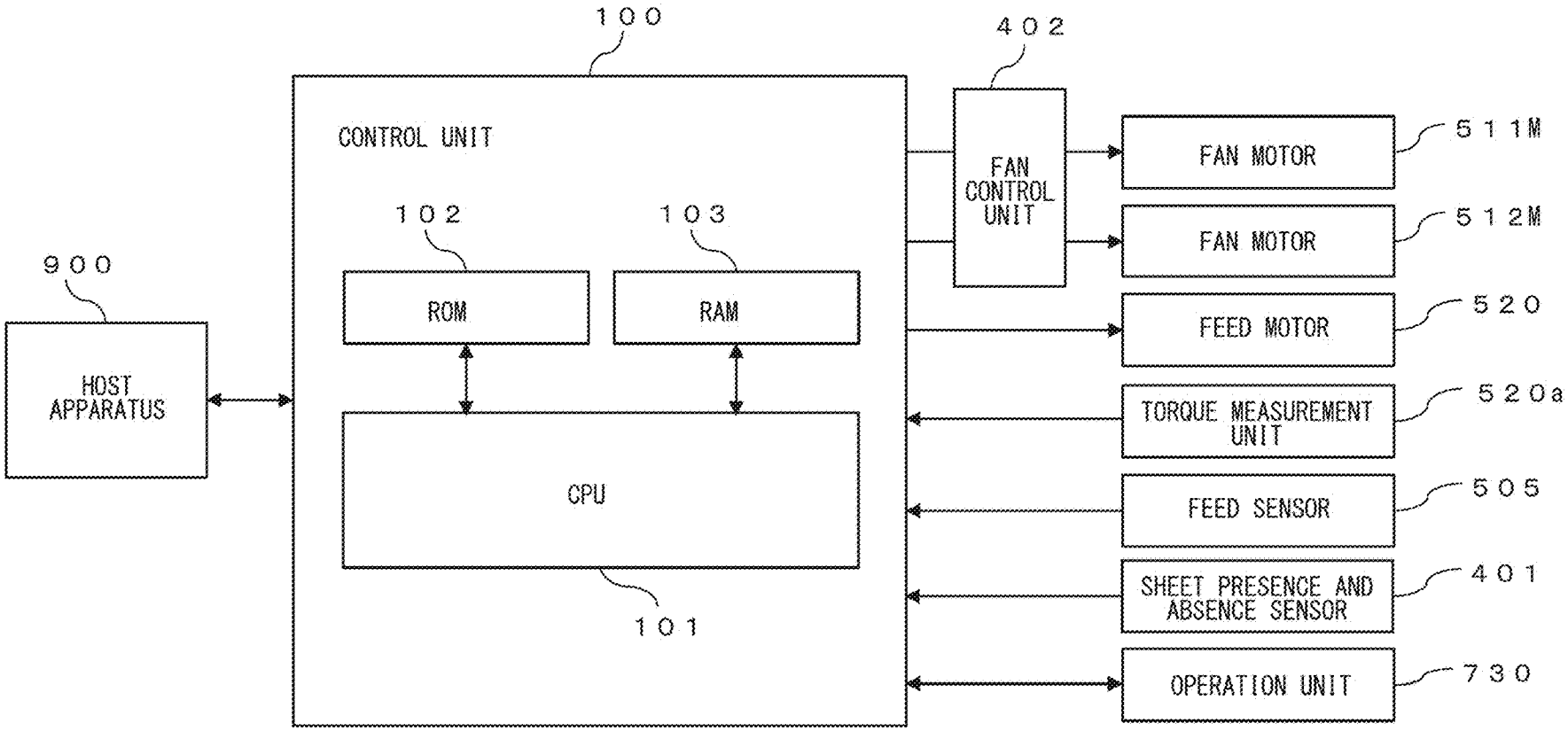
FIG. 2 is a block diagram illustrating a control system of the image forming system.

Next, using FIG. 2, a configuration of a control system in the image forming system 600 will be described. FIG. 2 is a block diagram illustrating the control system of the image forming system of the present embodiment.

A control unit 100 of the present embodiment is installed, for example, in the image forming apparatus 201. The control unit 100 includes a central processing unit (CPU) 101, a read only memory (ROM) 102, and a random access memory (RAM) 103. The ROM 102 stores various programs, and the CPU 101 executes each program by reading from the ROM 102. The RAM 103 is used as the workspace of the CPU 101. The control unit 100 coordinates and controls the image forming apparatus 201 and the feed deck 500. The control unit 100 is connected to a host apparatus 900 and the operation unit 730, and, while exchanging information with them, performs such as signal processing and sequence control for various process equipment. To be noted, the host apparatus 900 refers to an external apparatus such as a personal computer, an image scanner, and a facsimile machine. The operation unit 730 that can be operated by a user will be described below.

The control unit 100 is connected to a fan control unit 402 and a feed motor 520, serving as a motor that drives the pickup roller 501. Further, the control unit 100 is connected to such as a torque measurement unit 520*a* that measures the motor torque of the feed motor 520, and the feed sensor 505 and the sheet presence and absence sensor 401, described above. The fan control unit 402 is connected to the fan motors 511M and 512M, and, while performing the rotation control of the fans 511*b* and 512*b* through the fan motors 511M and 512M, simultaneously, performs failure detection for the fans 511*b* and 512*b*. Whether or not the fans 511*b* and 512*b* are out of order can be determined, for example, by counting the rotational speed of the fans 511*b* and 512*b*, and then assessing if counted rotations reach the intended number of rotations.

To be noted, while the torque measurement unit 520*a* refers to a unit that measures the motor torque of the feed motor 520, instead of this torque measurement unit 520*a*, it is acceptable to use, for example, a current sensor that detects a current value flowing through the feed motor 520, or a torque sensor that detects torque occurring on the pickup roller 501. That is, a specific configuration of the torque measurement unit 520*a* can be any configuration as long as the direct or indirect determination of the motor torque of the feed motor 520 is enabled.

Operation and Problem During Air Blowing

Figure 4:
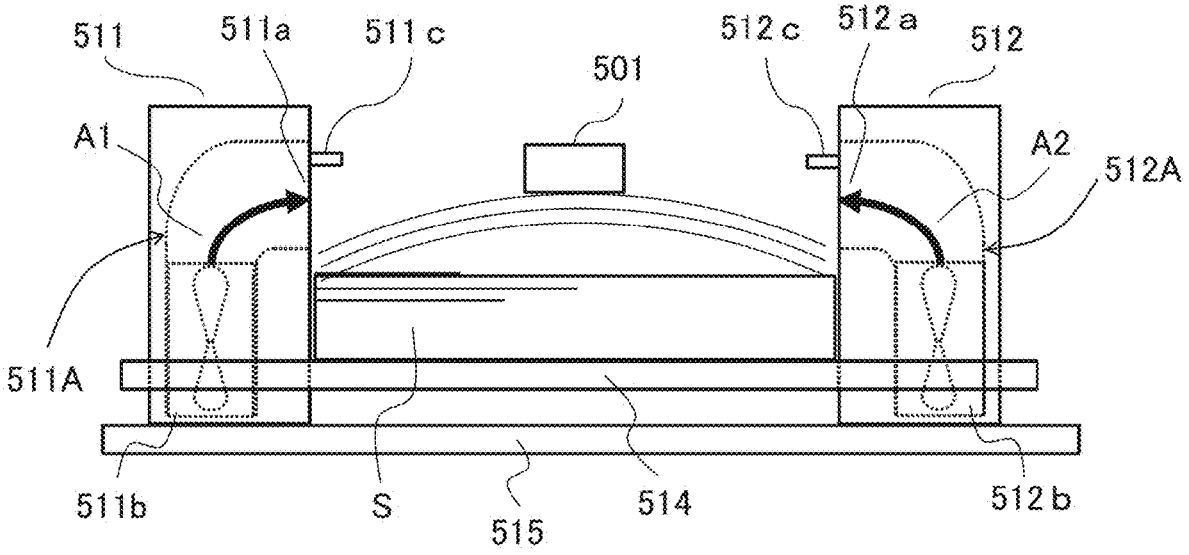
FIG. 4 is a schematic diagram illustrating a state in which an air blowing operation is executed in the manual sheet feed portion.

Next, using FIGS. 4 and 9, a state of the sheet S in a case where the air is blown from the sides of the sheet bundle by the air blowing units 511A and 512A, and problems encountered when the air is continued to be blown during the feeding of the sheet S will be described. FIG. 4 is a schematic diagram illustrating a state in which an air blowing operation (hereinafter referred to as an air blowing operation or a blowing operation) is performed in the manual sheet feed portion of the present embodiment. Further, FIG. 9 is an explanatory diagram illustrating the generation of turning force due to a positional relationship between the pickup roller 501 and the feed roller 502.

As illustrated in FIG. 4, in the air blowing operation, the fans 511*b* and 512*b* of the air blowing units 511A and 512A blow the air toward the sides of the sheet bundle, as shown by arrows A1 and A2. Then, a few to several dozen sheets of the sheet S at the top of the sheet bundle are separated and ascend, while the ascent of the sheet S being suppressed by the hold-down plates 511*c* and 512. Thereby, adhesion force between those ascended sheets of the sheet S is reduced, and, even if the sheet S is, for example, such as coated paper possessing a smooth surface property, it becomes possible to feed the sheet using the pickup roller 501.

Figure 9:
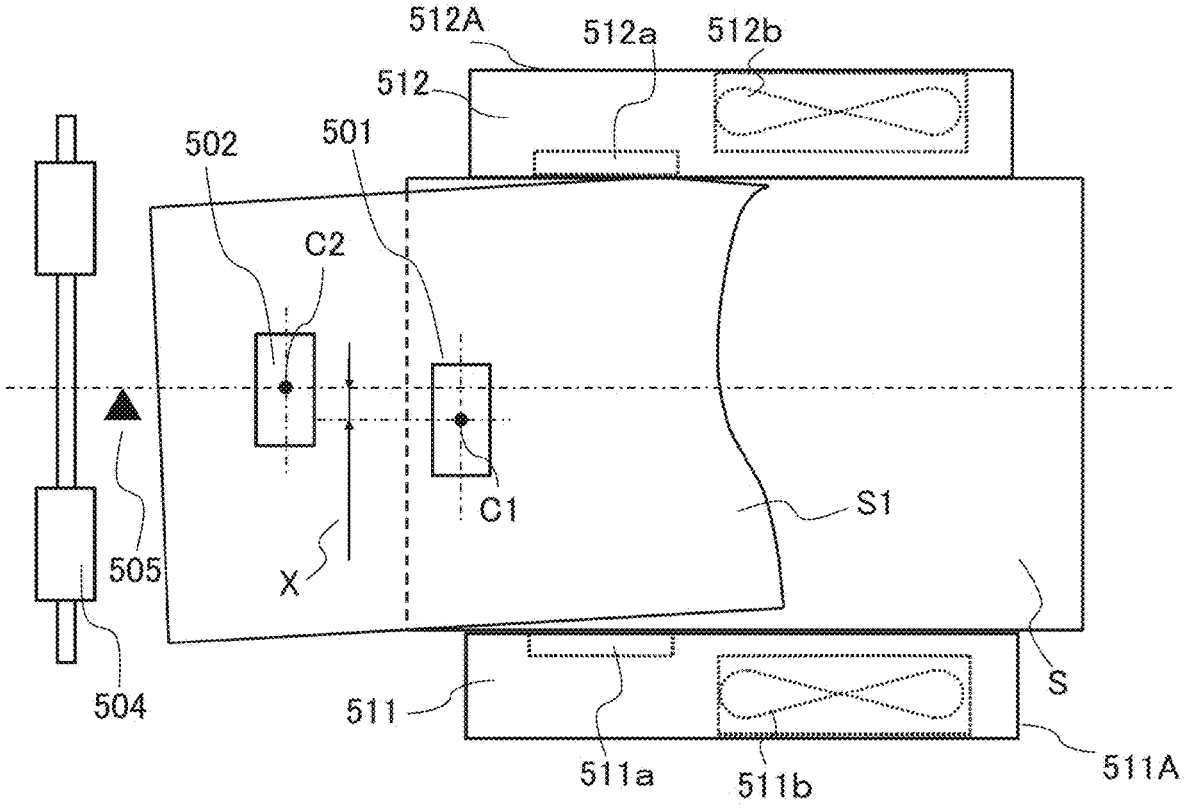
FIG. 9 is a diagram for illustrating the generation of turning force due to a positional relationship between a pickup roller and a feed roller.
Figure 10:
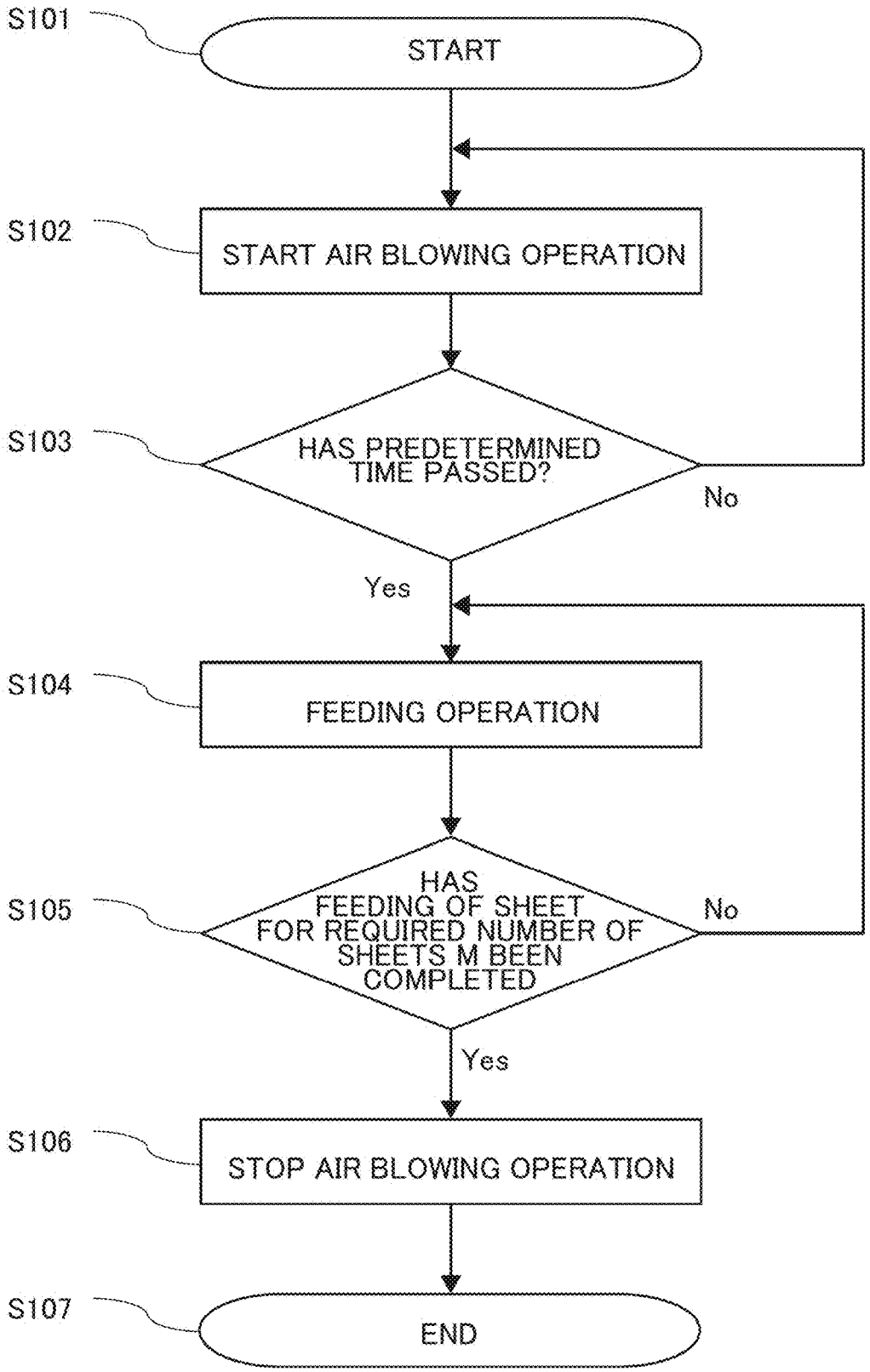
FIG. 10 is a flowchart illustrating standard sheet feeding control.

Incidentally, from a design perspective considering interactions with other parts, for example, as illustrated in FIG. 9, in the width direction orthogonal to the sheet feeding direction, a position of the center C1 of the pickup roller 501 with respect to the center C2 of the feed roller 502 is sometimes offset by, for example, a distance X. In such a case, when a conveyance load occurs due to such as variations in a conveyance speed near the pickup roller 501 during the conveyance of an uppermost sheet S1 by the feed roller 502, the turning force in a counterclockwise direction is generated on the sheet S1. Therefore, the sheet S1 is fed while rotating, and the skewing of the sheet S1 occurs. Here, normally, even if the turning force is generated on the sheet S1, the side edges of the sheet S1 come into contact with the side edge regulation plates 511 and 512, and the stiffness of the sheet S1 suppresses the skewing.

However, since the sheet S1 is ascended by the air blowing of the air blowing units 511A and 512A, as illustrated in FIG. 9, a bend is likely to occur in the sheet S1. Therefore, there is a problem in which, sometimes, the effectiveness of suppressing the skewing of the sheet S1 by the side edge regulation plates 511 and 512 may be reduced, and a skew amount of the sheet S1 may increase. Therefore, in the present embodiment, a sheet feeding control is performed as described below.

Sheet Feeding Control

Figure 5:
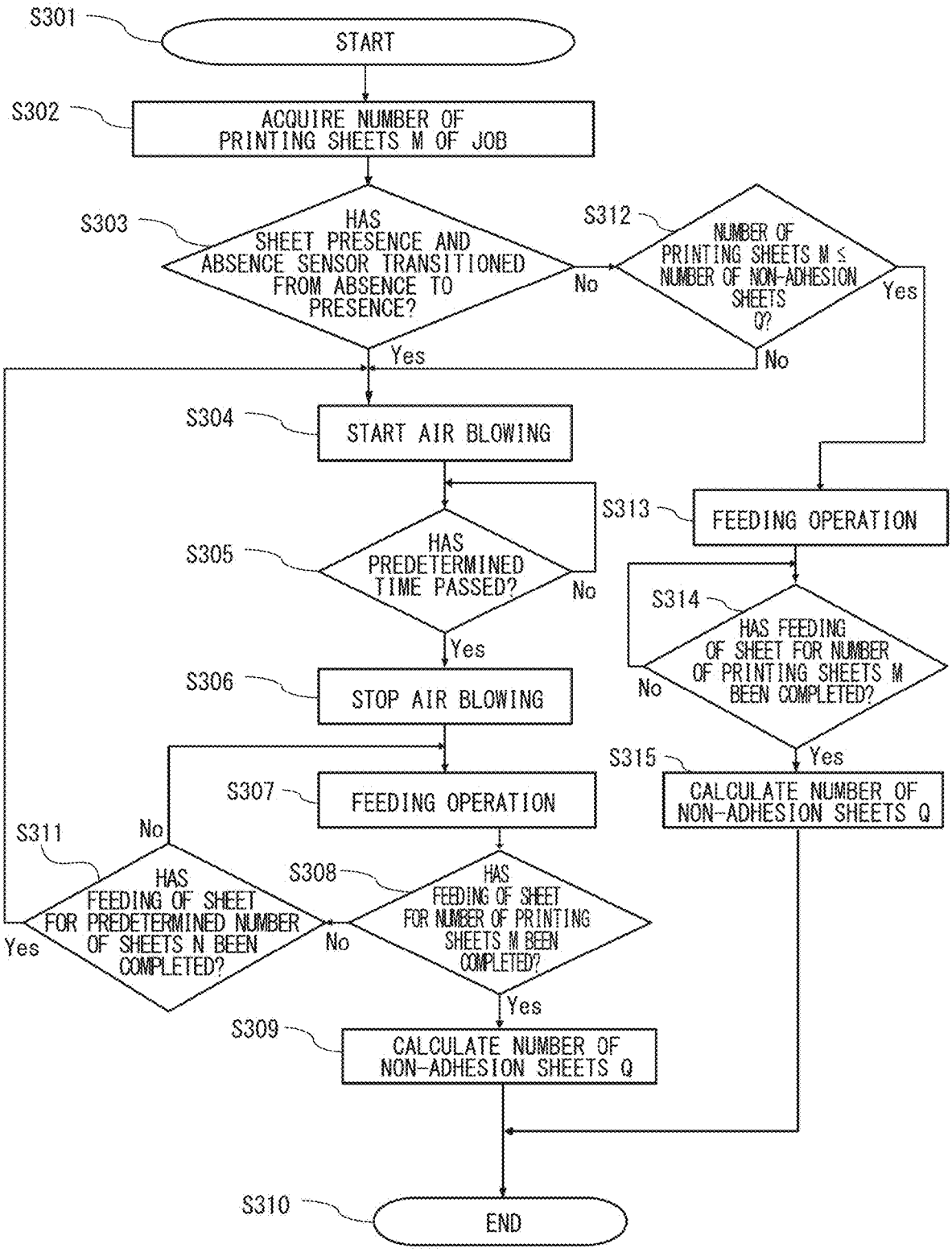
FIG. 5 is a flowchart illustrating the sheet feeding control of a first embodiment.

Next, using FIG. 5, the sheet feeding control of the manual sheet feed portion 235 of the present embodiment will be described. FIG. 5 is a flowchart illustrating the sheet feeding control of the first embodiment. Upon starting a print job (hereinafter, simply referred to as a job) by the image forming apparatus 201, the control unit 100 starts the sheet feeding control to feed the sheet (STEP S301).

Then, first, the control unit 100 acquires the number of printing sheets M for the job (STEP S302). Here, as an example, a case where the number of the prints M is 22 will be described. Next, the control unit 100 detects the presence and absence of the sheet S on the sheet supporting plate 514 of the manual feed tray 6 based on a detection result of the sheet presence and absence sensor 401. In particular, the control unit 100 detects whether or not the sheet presence and absence sensor 401 has transitioned from an absence state where the sheet does not exist on the sheet supporting plate 514 to a presence state where the sheet exists on the sheet supporting plate 514 (STEP S303). When the user newly sets the sheet bundle on the sheet supporting plate 514 which is devoid of any sheets, the sheet presence and absence sensor 401 transitions from the absence state to the presence state. To be noted, hereinafter, as an example, a case where the user has set on the sheet supporting plate 514 a sufficient number of sheets, such as 50 sheets, for conducting multiple print jobs will be described.

Further, in a case where the sheet presence and absence sensor 401 remains in the absence state for a predetermined period of time after the job has started, the control unit 100 displays a screen, which guides the user to set the sheet on the manual feed tray 6, on the operation unit 730.

In a case where the sheet presence and absence sensor 401 has transitioned from the absence state to the presence state (STEP S303: Yes), the control unit 100 starts the air blowing operation of blowing the air onto the sides of the sheet bundle by the air blowing units 511A and 512A (STEP S304). Thereby, a few to several dozen sheets of the sheet S at the top of the sheet bundle are separated and ascend while the ascent of the sheet S being suppressed by the hold-down plates 511*c* and 512 (refer to FIG. 4), and the adhesion force between the sheets is reduced.

Since the fan motors 511M and 512M starts rotation from a stationary state, a predetermined time, for example 10 seconds, is set in advance so as to ensure the time required for the fan motors 511M and 512M to reach a desired number of rotations (rotational speed) and ensure the time until the ascent of the sheet S stabilizes. Then, the air blowing operation is performed until the predetermined time has passed (STEP S305: No), and, when the predetermined time has passed (STEP S305: Yes), the control unit 100 ends the air blowing operation (STEP S306). That is, the control unit 100 turns off the drive of the fan motors 511M and 512M.

Thereby, the sheet S, which was in a floating state, attempts to return to a pre-floating state of the sheet bundle as the air between the sheets escapes, but it takes a certain amount of time before the sheet fully returns to the pre-floating state of the sheet bundle. Then, since the adhesion force between the sheets remains reduced until the sheet returns to the pre-floating state of the sheet bundle, even if the adhesion force in the sheet bundle is high, it is possible to feed a predetermined number of sheets N of the sheet S while suppressing double feeding. The predetermined number of sheets N, serving as a first number of sheets, is information stored in the RAM 103 in advance, and, in the present embodiment, is set to 10 sheets. The predetermined number of sheets N refers to the number of sheets that, while suppressing the double feeding, the manual sheet feed portion 235 can feed until the air between the sheets escapes and the sheet bundle returns to the pre-floating state.

Next, the control unit 100 starts a feeding operation of the sheet S (STEP S307). To be noted, the start of this feeding operation involves a process where the pickup roller 501 is rotatably driven by the feed motor 520 in a state in which the pickup roller 501 comes into contact with the uppermost sheet of the sheet S in the sheet bundle, and, thereby, the sheet S is fed. Thereafter, in a case of the double-feeding, the sheet S is separated in the separation unit constituted from the feed roller 502 and the retard roller 503, and the feed sensor 505 detects the passage of the sheet S.

Then, the control unit 100 determines whether or not the feeding of the sheet S for the number of printing sheets M has been completed (STEP S308). In a case where the feeding of the sheet S for the number of printing sheets M (in this example, 22 sheets) has not been completed (STEP S308: No), the control unit 100 determines whether or not the feeding of the sheet S for the predetermined number of sheets N (in this example, 10 sheets) has been completed (STEP S311). In a case where the feeding of the sheet S for the predetermined number of sheets N has not been completed (STEP S311: No), the control unit 100 returns to STEP S307, and performs the feeding operation with respect to a subsequent sheet S (STEP S307).

On the other hand, in a case where the feeding of the sheet S for the predetermined number of sheets N (in this example, 10 sheets) has been completed at STEP S311 (STEP S311: Yes), the control unit 100 executes the air blowing operation by the air blowing units 511A and 512A (STEP S304). As described above, in the sheet feeding control, until the feeding of the sheet S for the number of printing sheets M has been completed, the control unit 100 executes the air blowing operation by the air blowing units 511A and 512A each time when the feeding of the sheet S for the predetermined number of sheets N has been performed (STEPS S304 to S311).

When the feeding of the sheet S for the number of printing sheets M has been completed (STEP S308: Yes), the control unit 100 calculates the number of non-adhesion sheets Q (STEP S309). The number of non-adhesion sheets Q refers to the number of sheets of the sheet S which, upon completion of the job, remains on the sheet supporting plate 514 without being fed after separation by the air blowing operation. The number of non-adhesion sheets Q is determined by subtracting "the remainder obtained from dividing the number of printing sheets M by the predetermined number of sheets N" from "the predetermined number of sheets N". That is, Q is represented as:

$$Q=N-(M \bmod N)$$

In the present embodiment, given that N equals 10 and M equals 22, therefore M mod N equals 2. Therefore, Q equals 8. The calculated number of non-adhesion sheets Q, serving as a second number of sheets, is stored in, for example, the RAM 103. Consequently, the sheet feeding control of the first job is completed.

Upon completion of the preceding first job, a plurality of sheets (in this example, 50−22=28 sheets) are supported on the sheet supporting plate 514. The supported sheets described above include 8 sheets whose adhesion force between the sheets is already reduced by having been separated by the air blowing operation, and sheets, which have not been subjected to the air blowing operation, below the 8 sheets.

Next, as an example, a case where a second job subsequent to the first job as described above is executed will be described. Similar to the case of the first job, the control unit 100 acquires the number of printing sheets M of the second job (STEP S 302). Here, as an example, a case where the number of printing sheets M specified in the second job, serving as a third number of sheets, is 5 will be described. To be noted, since the sheet S is supported on the sheet supporting plate 514, the presence and absence sensor 401 is maintaining the presence state. Therefore, the control unit 100 proceeds from the "No" of STEP S303 to STEP S312.

The control unit 100 determines whether or not the number of printing sheets M is equal to or less than the number of non-adhesion sheets Q (STEP S312). Here, since the number of printing sheets M (in this example, 5 sheets) is equal to or less than the number of non-adhesion sheets Q (in this example, 8 sheets) (STEP S312: Yes), the control unit 100 determines that the air blowing operation is not necessary, and executes the feeding operation by omitting the air blowing operation (STEP S313). That is, the control unit 100 omits an initial air blowing operation of the second job. This is because all the sheets fed in the second job have already been separated by the air blowing operation in the first job.

Next, the control unit 100 determines whether or not the feeding of the sheet S for the number of printing sheets M (in this example, 5 sheets) has been completed (STEP S314). When the feeding of the sheet S for the number of printing sheets M has been completed (STEP S314: Yes), the control unit 100 calculates a new value for the number of non-adhesion sheets Q (STEP S315). Here, the number of non-adhesion sheets Q is determined by subtracting the number of printing sheets of the second job (in this example, 5 sheets) from the number of non-adhesion sheets upon completion of the first job (in this example, 8 sheets). That is, the new value for the number of non-adhesion sheets Q is 3. The newly calculated number of non-adhesion sheets Q is stored in, for example, the RAM 103. Consequently, the control unit 100 ends the sheet feeding control (STEP S310).

Next, as an example, a case where a third job subsequent to the second job as described above is executed will be described. Similar to the cases of the first and second jobs, the control unit 100 acquires the number of printing sheets M of the third job (STEP S302). Here, as an example, a case where the number of printing sheets M specified in the third job is 9 will be described. To be noted, since the sheet S is being supported on the sheet supporting plate 514, the sheet presence and absence sensor 401 is maintaining the presence state. Therefore, the control unit 100 proceeds from the "No" of STEP S303 to STEP S312.

The control unit 100 determines whether or not the number of printing sheets M is equal to or less than the number of non-adhesion sheets Q (STEP S312). Here, since the number of printing sheets M (in this example, 9 sheets) is larger than the number of non-adhesion sheets Q (in this example, 3 sheets) (STEP S312: No), the control unit 100 determines that the air blowing operation is necessary, and executes the air blowing operation (STEP S304). That is, the control unit 100 executes the air blowing operation before starting the feeding operation. This is because, while the first three sheets that are fed in the third job have already been separated by the air blowing operation in the first job, the remaining 6 sheets have not been separated by the air blowing operation.

Subsequently, as described above, the control unit 100 proceeds to STEPS S305 to S309, and calculates a new number for the number of non-adhesion sheets Q (STEP S309). Here, the number of non-adhesion sheets Q is determined in the same way as described in the first job. In this example, given that N equals 10 and M equals 9, therefore M mod N equals 9. Therefore, Q equals 1. That is, the new value for the number of non-adhesion sheets Q is 1. The newly calculated number of non-adhesion sheets Q is stored in, for example, the RAM 103. Consequently, the control unit 100 ends the sheet feeding control (STEP S310).

As described above, since, in the present embodiment, the air blowing units 511A and 512A perform the air blowing operation, it is possible to reduce the adhesion force between the sheets that possess the smooth surface property similar to coated paper and tend to have a high degree of the adhesion force between sheets. Thereby, it is possible to decrease defective conveyance which, for example, leads to the slippage of the pickup roller 501 and results in the sheet failing to be conveyed.

Further, since the sheet S is fed after the air blowing operation by the air blowing units 511A and 512A has been stopped, it is possible to reduce the skewing of the sheet. Therefore, since a required skew correction amount decreases at the time of correcting the skew of the sheet at the registration roller pair 240, variations in the positioning of the sheet that is conveyed to the secondary transfer portion 201D are reduced, and it is possible to improve printing accuracy (quality).

Further, in the present embodiment, upon completion of the job, the number of non-adhesion sheets Q, which is the number of sheets of the sheet S that remains on the sheet supporting plate 514 without being fed after the separation by the air blowing operation, is compared with the number of printing sheets M of the subsequent job. Then, since the control unit 100 executes the feeding operation by omitting the air blowing operation in a case where the number of printing sheets M is equal to or less than the number of non-adhesion sheets Q, it is possible to improve productivity while suppressing the defective sheet conveyance. Further, since it is possible to omit an unnecessary air blowing operation, it is possible to reduce the power consumption of the image forming apparatus 201.

Second Embodiment

While, next, a second embodiment of this disclosure will be described, the second embodiment is configured by modifying the sheet feeding control of the first embodiment. Therefore, regarding configurations similar to the first embodiment, illustrations will be omitted herein, or descriptions will be provided by putting the same reference characters on drawings.

Figure 6:
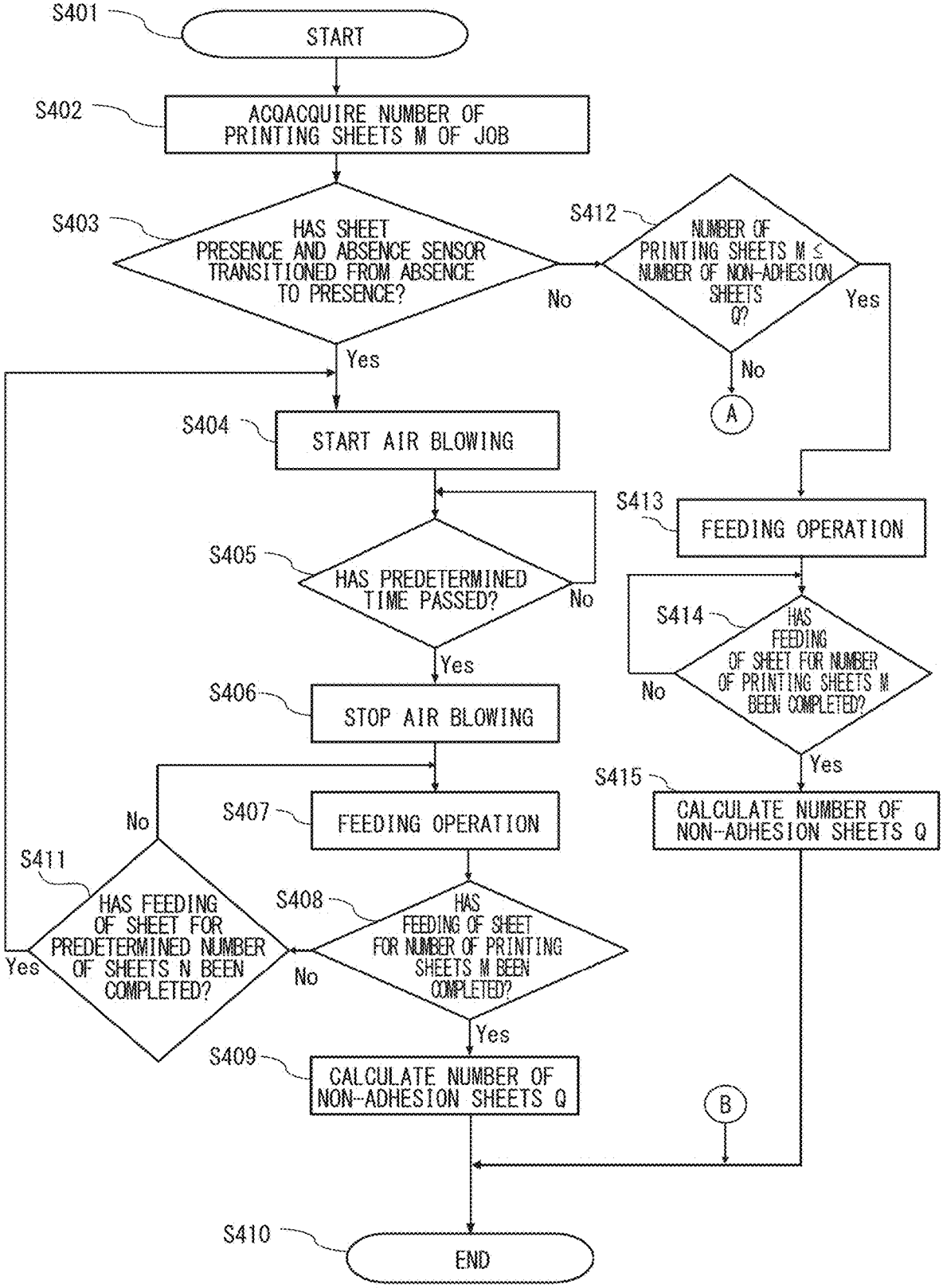
FIG. 6 is a flowchart illustrating the sheet feeding control of a second embodiment.
Figure 7:
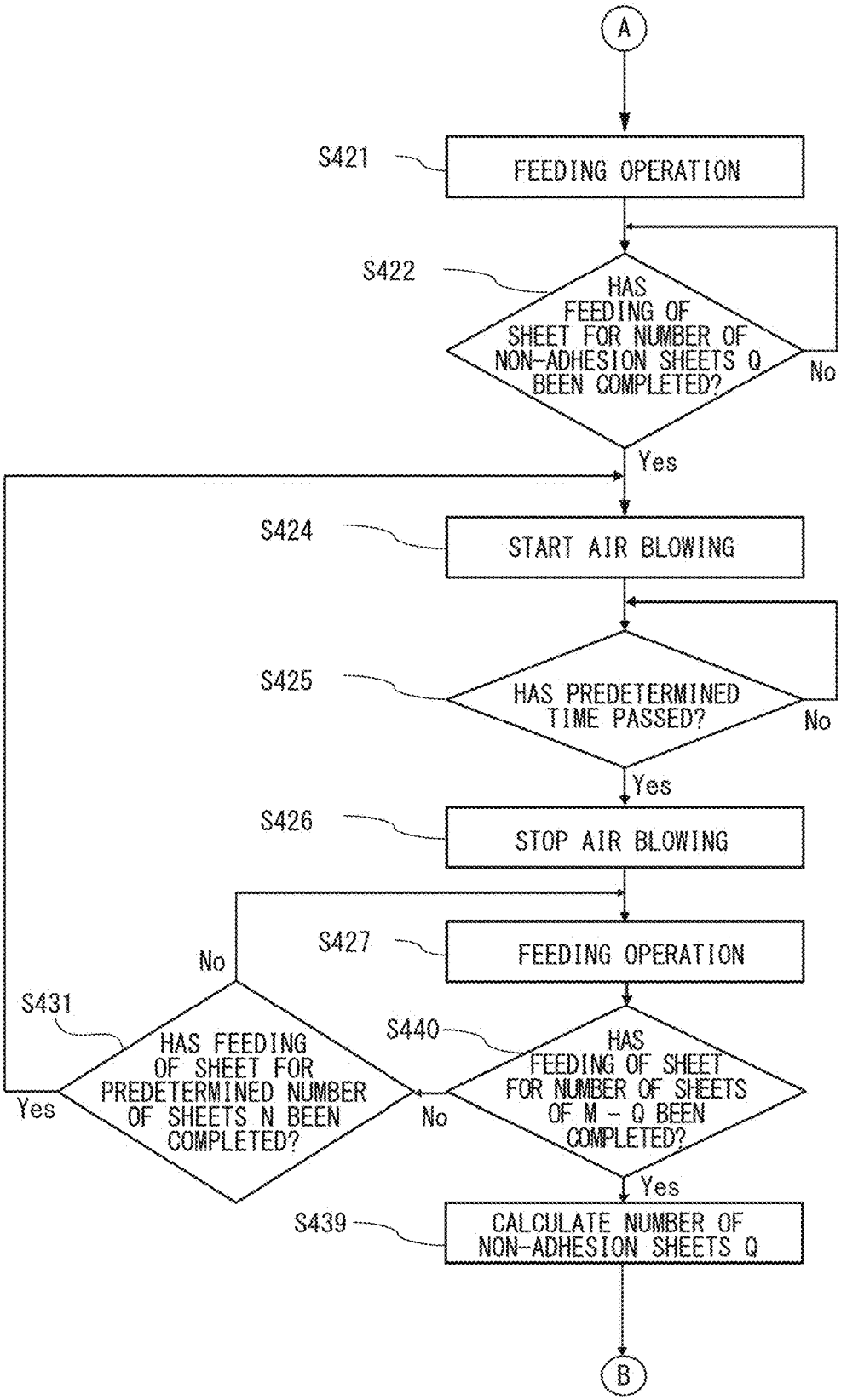
FIG. 7 is a flowchart illustrating the sheet feeding control of the second embodiment.

FIGS. 6 and 7 are flowcharts illustrating the sheet feeding control of the second embodiment. Since STEPS S401 to S415 of FIG. 6 are similar to STEPS S301 to S315 of FIG. 5, descriptions will be omitted. That is, the sheet feeding control of the second embodiment is different from the sheet feeding control of the first embodiment only in STEPS S424 to S439, following the "No" in STEP S412 in FIG. 6.

Hereinafter, a case where the number of non-adhesion sheets Q upon completion of the first job is 3 and the second job, whose number of printing sheets M is 19, is started will be described. As illustrated in FIG. 6, when the second job is started (STEP S401), the control unit 100 acquires the number of printing sheets M of the second job (STEP S402). In this example, the number of printing sheets M is 19. To be noted, since the sheet is already supported on the sheet supporting plate 514, the sheet presence and absence sensor 401 is maintaining the presence state. Therefore, the control unit 100 proceeds from the "No" of STEP S403 to STEP S412.

The control unit 100 determines whether or not the number of printing sheets M is equal to or less than the number of non-adhesion sheets Q (STEP S412). Here, since the number of printing sheets M (in this example, 19 sheets) is larger than the number of non-adhesion sheets Q (in this example, 3 sheets) (STEP S412: No), the control unit 100 proceeds to STEP S421 of FIG. 7. That is, the control unit omits an initial air blowing operation of the second job.

Then, as illustrated in FIG. 7, the control unit 100 starts the feeding operation of the sheet S (STEP S421). Next, the control unit 100 determines whether or not the feeding of the sheet S for the number of non-adhesion sheets Q (in this example, 3) has been completed (STEP S422). In a case where the feeding of the sheet S for the number of non-adhesion sheets Q (in this example, 3) has been completed (STEP S422: Yes), the control unit 100 starts the air bowing operation by the air blowing units 511A and 512A (STEP S424).

That is, in this example, while the first 3 sheets that are fed in the second job have already been separated by the air blowing operation in the first job, the remaining 16 sheets have not been separated by the air blowing operation. Therefore, the air blowing operation is not necessary for the first 3 sheets, but is necessary for the remaining 16 sheets.

STEPS S424 to S427, S431, and S439 of FIG. 7 are the same as STEPS S304 to S307, S311, and S309 of FIG. 5. The control unit 100 executes the air blowing operation until the predetermined time has passed (STEP S425: No), and, when the predetermined time has passed (STEP S425: Yes) stops the air blowing operation (STEP S426), that is, turns off the drive of the fan motors 511M and 512M.

Next, the control unit 100 starts the feeding operation of the sheet S (STEP S427). Then, the control unit 100 determines whether or not the feeding of the sheet S has been completed for the remaining number of printing sheets (in this example, 16 sheets), which is obtained by subtracting the number of non-adhesion sheets Q (in this example, 3 sheets) from the number of printing sheets M (in this example, 19 sheets) (STEP S440). In a case where the feeding of these sheets of the sheet S has not been completed (STEP S440: No), the control unit 100 determines whether or not the feeding of the sheet S for the predetermined number of sheets N (in this example, 10 sheets) has been completed (STEP S431). In a case where the feeding of the sheet S for the predetermined number of sheets N has not been completed (STEP S431: No), the control unit returns to STEP S427, and executes the feeding operation with respect to the subsequent sheet S (STEP S427).

In a case where the feeding of the sheet S for the remaining number of printing sheets (in this example, 16 sheets) has been completed (STEP S440: Yes), the control unit 100 calculates a new value for the number of non-adhesion sheets Q (STEP S439). Here, the number of non-adhesion sheets Q is calculated by subtracting "the remainder obtained by dividing a difference between the number of printing sheets M and the number of non-adhesion sheets remaining on the sheet supporting plate 514 upon completion of the preceding job S by the predetermined number of sheets N" from "the predetermined number of sheets N". That is, Q is represented as:

$$Q=N-[(M-S)\bmod N]$$

In this example, with M=19, N=10, and S=3, the difference between the number of printing sheets M and the number of non-adhesion sheets remaining on the sheet supporting plate 514 upon completion of the preceding job S, that is, the remaining number of printing sheets=M−S=16, therefore (M−S) mod N equals 6. Therefore, Q equals 4. The new value for the number of non-adhesion sheets Q is stored in, for example, the RAM 103. Consequently, the control unit 100 ends the sheet feeding control (STEP S410).

As a result, it is possible to achieve effects similar to those of the first embodiment. Further, in the present embodiment, for the sheet which has already been separated in the first job, the feeding is performed by omitting the air blowing operation, and, for the remaining number of printing sheets of the job, the feeding is performed after executing the air blowing operation. Thereby, it is possible to achieve both the suppression of the defective sheet conveyance and the enhancement of the productivity.

Third Embodiment

While, next, a third embodiment of this disclosure will be described, the third embodiment is configured by modifying the sheet feeding control of the first embodiment. Therefore, regarding configurations similar to the first embodiment, illustrations will be omitted herein, or descriptions will be provided by putting the same reference characters on drawings.

Figure 8:
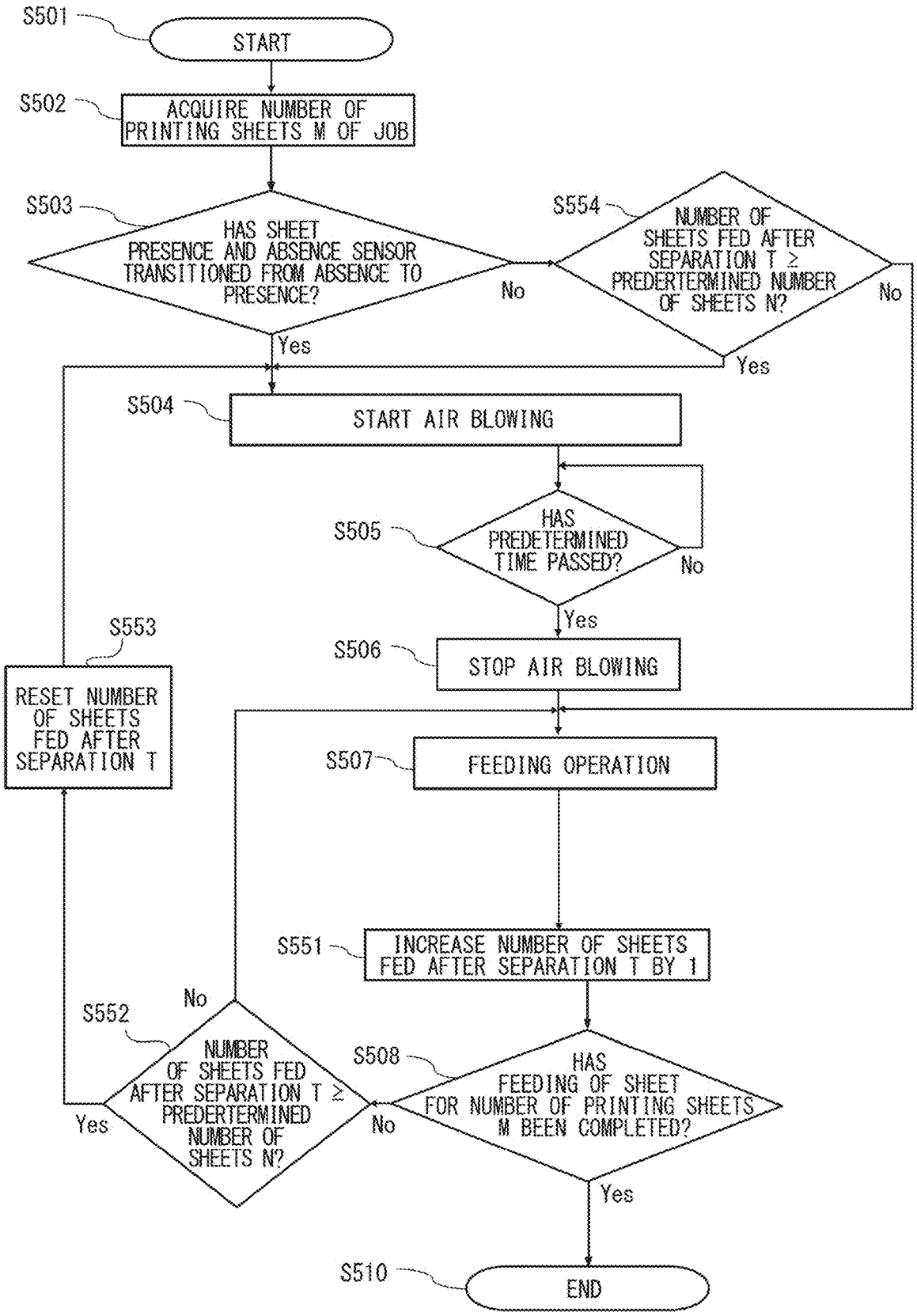
FIG. 8 is a flowchart illustrating the sheet feeding control of a third embodiment.

FIG. 8 is a flowchart illustrating the sheet feeding control of the third embodiment. Since STEPS S501 to S508 of FIG. 8 are similar to STEPS S301 to S308 of FIG. 5, descriptions will be omitted.

Hereinafter, a case of starting a first job with the number of printing sheets M of 15 sheets will be described. As illustrated in FIG. 8, when the first job is started (STEP S501), the control unit 100 acquires the number of printing sheets M of the first job (STEP S502). In this example, the number of printing sheets M is 15 sheets. Next, the control unit 100 determines whether or not the sheet presence and absence sensor 401 transitions from the absence state to the presence state (STEP S503). When the user sets a new sheet bundle on the sheet supporting plate 514, where no sheets are placed, the sheet presence and absence sensor 401 transitions from the absence state to the presence state. To be noted, hereinafter, as an example, a case where the user has set on the sheet supporting plate 514 a sufficient number of sheets, such as 50 sheets, for conducting multiple print jobs will be described.

Since STEPS S504 to S507 are similar to STEPS S304 to S307 of FIG. 5, descriptions will be omitted. When a single sheet of the sheet S is fed, the control unit 100 increases a count of the number of sheets fed after separation T by one (STEP S551). The number of sheets fed after the separation T, serving as a fourth number of sheets, corresponds to the number of sheets fed after the execution of the air blowing operation.

Then, the control unit 100 determines whether or not the feeding of the sheet S for the number of printing sheets M has been completed (STEP S508). In a case where the feeding of the sheet S for the number of printing sheets M (in this example, 15 sheets) has not been completed (STEP S508: No), the control unit 100 determines whether or not the number of sheets fed after the separation T is equal to or more than the predetermined number of sheets N (STEP S552). In a case where the number of sheets fed after the separation T is less than the predetermined number of sheets N (STEP S552: No), the control unit 100 returns to STEP S507, and feeds the subsequent single sheet of the sheet S (STEP S507). Then, the control unit 100 repeats STEPS S507, S551, S508, and S552 until the predetermined number of sheets N of the sheet S is fed.

In a case where, when 10 sheets of the sheet S have been fed and, at STEP S552, the number of sheets fed after the separation T has become equal to or more than the predetermined number of sheets N (STEP S552: Yes), the control unit 100 resets the number of sheets fed after the separation T to 0 (STEP S553). Then, the control unit 100 returns to STEP S504, and starts the air blowing operation (STEP S504).

Then, when the feeding of the remaining number of printing sheets of the first job, which is 5 sheets, has been completed (STEP S508: Yes), the control unit 100 ends the sheet feeding control (STEP S510). At this time, for the number of sheets fed after the separation T, T=5 is recorded. To be noted, the number of sheets fed after the separation T is stored in, for example, the RAM 103.

Next, as an example, a case where a second job subsequent to the first job as described above is executed will be described. When the second job is started (STEP S501), the control unit 100 acquires the number of printing sheets M of the second job (STEPS502). In this example, the number of printing sheets M of the second job is 4 sheets. To be noted, since the sheet is already supported on the sheet supporting plate 514, the sheet presence and absence sensor 401 is maintaining the presence state. Therefore, the control unit 100 proceeds from the "No" of STEP S503 to STEP S554.

The control unit 100 determines whether or not the number of sheets fed after the separation T is equal to or more than the predetermined number of sheets N (STEP S554). In a case where the number of sheets fed after the separation T is less than the predetermined number of sheets N (STEP S554: No), the control unit 100 returns to STEP S507, and feeds a single sheet of the sheet S (STEP S507). In this example, since the number of sheets fed after the separation T equals 5 and the predetermined number of sheets N equals 10, the feeding operation (STEP S507) is performed by omitting the air blowing operation (STEPS S504 to S506). That is, the control unit 100 omits an initial air blowing operation of the second job. This is because, by the air blowing operation in the first job, N−T=5 sheets are supported on the sheet supporting plate 514 in an already separated state.

Then, when the feeding of the sheet for the number of printing sheets M of the second job, which is 4 sheets, has been completed (STEP S508: Yes), the control unit 100 ends the sheet feeding control (STEP S510). At this time, for the number of sheets fed after the separation T, T=5+4=9 is recorded.

Next, as an example, a case where a third job subsequent to the second job as described above is executed will be described. When the third job is started (STEP S501), the control unit 100 acquires the number of printing sheets M of the third job (STEP S502). In this example, the number of printing sheets M of the third job is 4 sheets. To be noted, since the sheet is already supported on the sheet supporting portion 514, the sheet presence and absence sensor 401 is maintaining the presence state. Therefore, the control unit 100 proceeds from the "No" of STEP S503 to STEP S554.

The control unit 100 determines whether or not the number of sheets fed after the separation T is equal to or more than the predetermined number of sheets N (STEP S554). In a case where the number of sheets fed after the separation T is less than the predetermined number of sheets N (STEP S554: No), the control unit 100 proceeds to STEP S507, and feeds a single sheet of the sheet S (STEP S507). In this example, since the number of sheets fed after the separation T equals 9 and the predetermined number of sheets N equals 10, the feeding operation (STEP S507) is performed by omitting the air blowing operation (STEPS S504 to S506). This is because, by the air blowing operation in the first job, N-T=1 sheet is supported on the sheet supporting plate 514 in the already separated state.

Then, when a single sheet of the sheet S is fed, the control unit 100 increases the count value of the number of sheets fed after the separation T by one (STEP S551), and the number of sheets fed after the separation T becomes 9+1=10. Then, the control unit 100 proceeds to the "No" of STEP S508 and the "Yes" of STEP S552, and resets the number of sheets fed after the separation T (STEP S553).

Thereafter, by proceeding to STEP S504, the control unit 100 starts the air blowing operation (STEP S504), and performs the processing of STEPS S504 to S507, S551, S508, and S552 until the feeding of the remaining number of printing sheets of the third job, which is 3 sheets, has been completed. Then, in a case where the feeding of the sheet S for the number of printing sheets M (in this example, 4 sheets) has been completed (STEP S508: Yes), the control unit 100 ends the sheet feeding control (STEP S510). To be noted, at this time, for the number of sheets fed after the separation T, T=3 is recorded.

As a result, it is possible to achieve effects similar to those of the first and second embodiments.

To be noted, while, in the present embodiment, the timing of the air blowing operation is controlled by increasing the number of sheets fed after the separation T by one each time when a single sheet of the sheet S is fed, it is not limited to this. For example, it is acceptable to configure such that, by subtracting one from the predetermined number of sheets N (number of sheets that can be fed) each time when a single sheet of the sheet S is fed, the air blowing operation is executed when the predetermined number of sheets N (number of sheets that can be fed) becomes 0.

Other Embodiments

To be noted, in any of the embodiments described above, the sheet feeding control is performed in the manual sheet feed portion 235 including the air blowing units 511A and 512A. However, it is not limited to this, and it is acceptable that the sheet feeding control of the present embodiment is performed in such as the sheet feed unit 230 including the feed cassette 1 or the feed deck 500 by including an air blowing unit in the feed cassette 1 or the feed deck 500. Further, in a case where the sheet feeding control of the present embodiment is performed in the sheet feed unit 230, it may be performed at any stage in a vertical direction. That is, a sheet supporting portion that supports the sheet bundle can be of any configuration.

Further, in any of the embodiments described above, the sheet feeding unit includes the pickup roller for feeding the sheet, and the feed roller and the retard roller for separating the double-fed sheet. However, it is not limited to this, and, a configuration of the sheet feeding unit that feeds the sheet may be of any type, for example, such as a configuration using vacuum suction to adhere the sheet to such as belts for the feeding.

Further, in any of the embodiments described above, the control unit 100 is installed in the image forming apparatus 201. However, it is not limited to this, and the control unit 100 may be installed in the feed deck 500. That is, if a control unit capable of controlling both the sheet feeding unit and the air blowing unit is electrically connected to both the units, the control unit may be arranged in either apparatus.

Further, while, in the embodiments described above, the predetermined number of sheets is set to 10 sheets, it is not limited to this. That is, since the number of sheets at the top of the sheet bundle, which is ascended by the air blowing operation, may vary depending on such as a grammage of the sheet, the predetermined number of sheets may be changed based on such as the properties of the sheet being fed and a surrounding temperature and humidity environment.

Further, while, in any of the embodiments described above, the air is blown to both the side surfaces in the width direction of the sheet bundle supported on the sheet supporting plate 514, it is not limited to this. For example, the air may be blown to only one side of the side surfaces in the width direction of the sheet bundle, or may be blown to a side surface of the sheet bundle on either a front or a back side.

Further, while, in any of the embodiments described above, the image forming apparatus 201 includes the manual sheet feed portion 235, serving as the sheet feeding apparatus, and the control unit 100, it is not limited to this. For example, it is acceptable to consider that the image forming system 600 including the feed deck 500 and image forming apparatus 201 is the sheet feeding apparatus. Further, it is acceptable to consider that the manual sheet feed portion 235 and the control unit 100 are the sheet feeding apparatus.

Further, while, in any of the embodiments described above, descriptions are provided by using the image forming apparatus 201 of the electrophotographic system, this disclosure is not limited to this. For example, this disclosure can be also applied to an image forming apparatus of an inkjet system which forms the image on the sheet by ejecting a liquid ink through a nozzle.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2023-115501, filed Jul. 13, 2023, which is hereby incorporated by reference herein in its entirety.

What is claimed is:

1. A sheet feeding apparatus comprising:

a sheet supporting portion configured to support a sheet bundle;

a sheet feeding unit configured to perform a feeding operation of coming into contact with and feeding an uppermost sheet of the sheet bundle supported on the sheet supporting portion;

an air separation unit configured to perform a blowing operation of separating a sheet by blowing air to a side surface of the sheet bundle supported on the sheet supporting portion; and a control unit configured to execute a sheet feeding control of executing the blowing operation by the air separation unit, of stopping the blowing operation, and of executing the feeding operation in a state in which the blowing operation is stopped, the control unit, in the sheet feeding control, being configured to execute the blowing operation each time when a first number of sheets has been fed until feeding the sheet for a number of printing sheets as specified by a job has been completed, and wherein, in the sheet feeding control, in a case where a second number of sheets, separated by the blowing operation but not fed, remains on the sheet supporting portion at an end of a first job, and a number of printing sheets of a second job subsequent to the first job is a third number of sheets that is equal to or less than the second number of sheets, the control unit omits an initial blowing operation and starts the feed operation in the second job.

2. The sheet feeding apparatus according to claim 1, wherein, in the sheet feeding control, the control unit is configured to execute the blowing operation before starting the feeding operation in the second job in a case where the third number of sheets is larger than the second number of sheets.

3. The sheet feeding apparatus according to claim 1, wherein, in the sheet feeding control, in a case where the third number of sheets is larger than the second number of sheets, the control unit omits the initial blowing operation, starts the feeding operation with respect to the second number of sheets, and executes the blowing operation in the second job when the feeding operation with respect to the second number of sheets has been completed.

4. The sheet feeding apparatus according to claim 1, wherein the second number of sheets is determined by subtracting a remainder, obtained by dividing the number of printing sheets by the first number of sheets, from the first number of sheets.

5. The sheet feeding apparatus according to claim 4, wherein, the second number of sheets at an end of the second job is determined by subtracting a remainder, obtained by dividing a difference between the number of printing sheets and the second number of sheets at the end of the first job by the first number of sheets, from the first number of sheets in a case where the third number of sheets is more than the second number of sheets.

6. The sheet feeding apparatus according to claim 1, further comprising a casing, wherein the sheet supporting portion is a manual feed tray that is supported with respect to the casing in an openable and closable manner.

7. The sheet feeding apparatus according to claim 1, further comprising a regulation portion that is configured to regulate a position of the side surface of the sheet bundle that is supported on the sheet supporting portion, wherein the air separation unit is disposed in the regulation portion.

8. The sheet feeding apparatus according to claim 7, wherein the air separation unit includes:

a fan configured to send the air; and an air blowing port configured to blow the air sent from the fan to the side surface of the sheet bundle supported on the sheet supporting portion.

9. The sheet feeding apparatus according to claim 7, wherein the regulation portion is configured to regulate the position of the side surface in a width direction orthogonal to a sheet feeding direction of the sheet bundle supported on the sheet supporting portion.

10. The sheet feeding apparatus according to claim 1, further comprising an image forming unit configured to form an image on the sheet.

11. A sheet feeding apparatus comprising:

a sheet supporting portion configured to support a sheet bundle;

a sheet feeding unit configured to perform a feeding operation of coming into contact with and feeding an uppermost sheet of the sheet bundle supported on the sheet supporting portion;

an air separation unit configured to perform a blowing operation of separating a sheet by blowing air to a side surface of the sheet bundle supported on the sheet supporting portion; and a control unit configured to execute a sheet feeding control of executing the blowing operation by the air separation unit, of stopping the blowing operation, and of executing the feeding operation in a state in which the blowing operation is stopped, the control unit, in the sheet feeding control, being configured to execute the blowing operation each time when a first number of sheets has been fed until feeding of the sheet for a number of printing sheets as specified by a job has been completed, and wherein, in the sheet feeding control, in a case where a fourth number of sheets fed after the blowing operation is less than the first number of sheets at an end of a first job, the control unit omits an initial blowing operation and starts the feed operation in a second job subsequent to the first job.

12. The sheet feeding apparatus according to claim 11, wherein, in the sheet feeding control in the second job, in a case where the fourth number of sheets becomes equal to or more than the first number of sheets, the control unit executes the blowing operation.

13. The sheet feeding apparatus according to claim 11, further comprising a casing, wherein the sheet supporting portion is a manual feed tray that is supported with respect to the casing in an openable and closable manner.

14. The sheet feeding apparatus according to claim 11, further comprising a regulation portion that is configured to regulate a position of the side surface of the sheet bundle that is supported on the sheet supporting portion, wherein the air separation unit is disposed in the regulation portion.

15. The sheet feeding apparatus according to claim 14, wherein the air separation unit includes:

a fan configured to send the air, and an air blowing port configured to blow the air sent from the fan to the side surface of the sheet bundle supported on the sheet supporting portion.

16. The sheet feeding apparatus according to claim 14, wherein the regulation portion is configured to regulate the position of the side surface in a width direction orthogonal to a sheet feeding direction of the sheet bundle supported on the sheet supporting portion.

17. The sheet feeding apparatus according to claim 11, further comprising an image forming unit configured to form an image on the sheet.

* * * * *